US006988851B2

(12) United States Patent
Sina

(10) Patent No.: US 6,988,851 B2
(45) Date of Patent: Jan. 24, 2006

(54) CONCRETE SCREED WITH VIBRATION ISOLATION

(75) Inventor: Paul M. Sina, Jackson, WI (US)

(73) Assignee: M-B-W Inc., Slinger, WI (US)

( * ) Notice: Subject to any disclaimer, the term of this patent is extended or adjusted under 35 U.S.C. 154(b) by 65 days.

(21) Appl. No.: 10/706,539

(22) Filed: Nov. 12, 2003

(65) Prior Publication Data

US 2005/0100407 A1 May 12, 2005

(51) Int. Cl.
*E01C 19/38* (2006.01)

(52) U.S. Cl. ..... 404/114; 404/118; 404/97; 74/574

(58) Field of Classification Search ..... 404/96, 404/97, 101, 102, 118–120, 113, 114; 74/573 R, 74/574

See application file for complete search history.

(56) References Cited

U.S. PATENT DOCUMENTS

| | | | | |
|---|---|---|---|---|
| 4,591,291 A | | 5/1986 | Owens | |
| 5,244,305 A | * | 9/1993 | Lindley | 404/97 |
| 5,375,942 A | * | 12/1994 | Lindley et al. | 404/97 |
| 5,460,461 A | | 10/1995 | McGrath | |
| 5,540,519 A | | 7/1996 | Weber | |
| 5,980,154 A | | 11/1999 | Record | |
| 5,984,571 A | * | 11/1999 | Owens | 404/97 |
| 6,231,331 B1 | | 5/2001 | Lievers | |
| 6,296,467 B1 | * | 10/2001 | Rouillard | 425/182 |
| 6,705,799 B2 | * | 3/2004 | Piccoli | 404/97 |
| 2003/0068200 A1 | * | 4/2003 | Quenzi et al. | 404/114 |

OTHER PUBLICATIONS

Advanced Concrete Tools, Product Decription; Weber Concrete Tools—Products Page; http://www.concretescreed-.com/products,htm; Oct. 25, 2003.

Magic Screeds; Allen Engineering Corporation | Magic Screeds; http://www.alleneng.com/html_magicscreeds; Oct. 25, 2003.

* cited by examiner

*Primary Examiner*—Robert E. Pezzuto
*Assistant Examiner*—Alexandra K. Pechhold
(74) *Attorney, Agent, or Firm*—Andrus, Sceales, Starke & Sawall, LLP

(57) ABSTRACT

A vibratory concrete screed includes a vibration isolation system that minimizes the transmission of vibrations to the operator under normal operating conditions, but becomes more rigid during screed control forces applied to the blade through the isolation system when the operator applies greater forces to the operator handle. The system includes low durometer elastomer vibration isolators isolating the operator handle from the vibration exciter and screed blade in a manner that limits vertical compressive movement of the isolators, yet permits substantially greater horizontal shear movement to effectively isolate the operator from vibration. The isolator mounting arrangement also includes retainers that engage the isolator to limit the amplitude of horizontal shear movement when the operator applies a greater control force to the operator handle.

20 Claims, 3 Drawing Sheets

FIG. 3
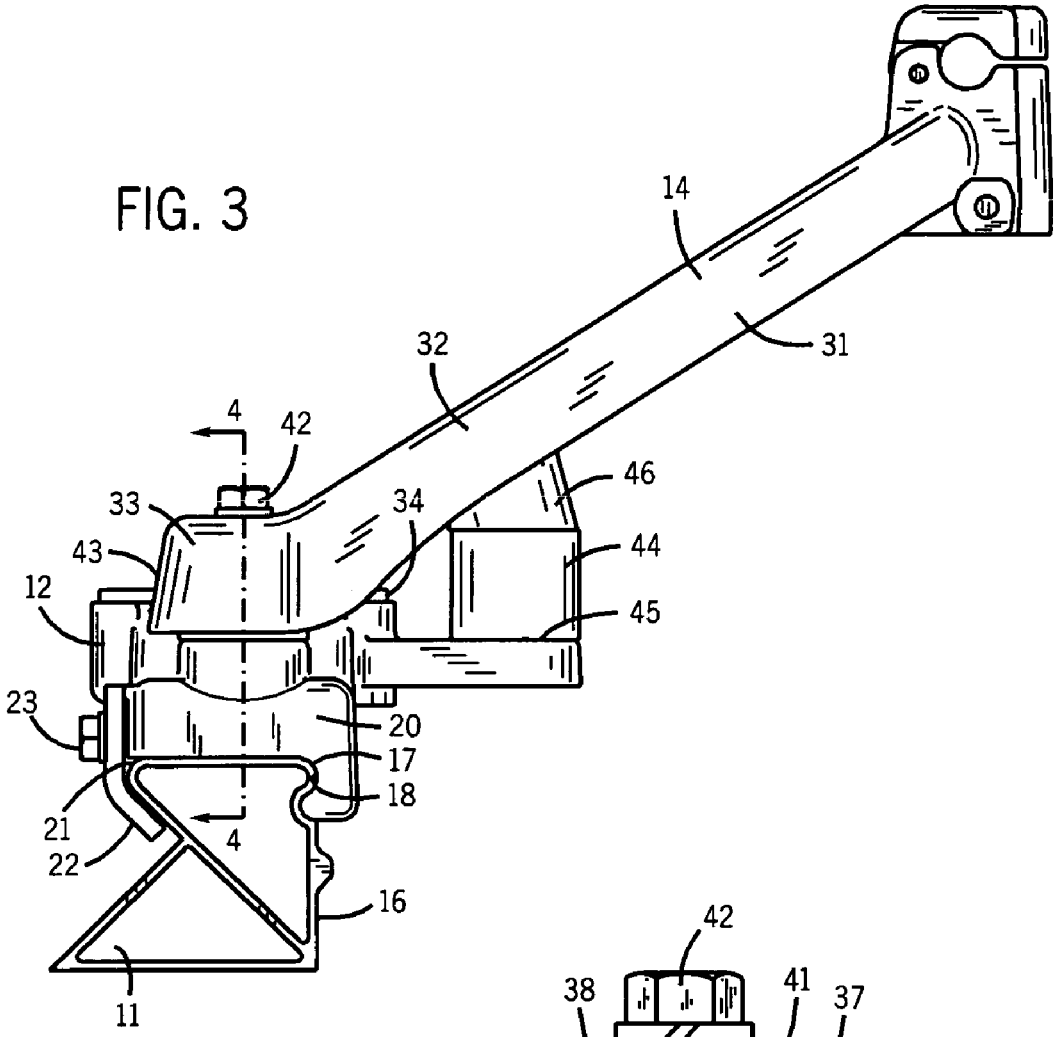
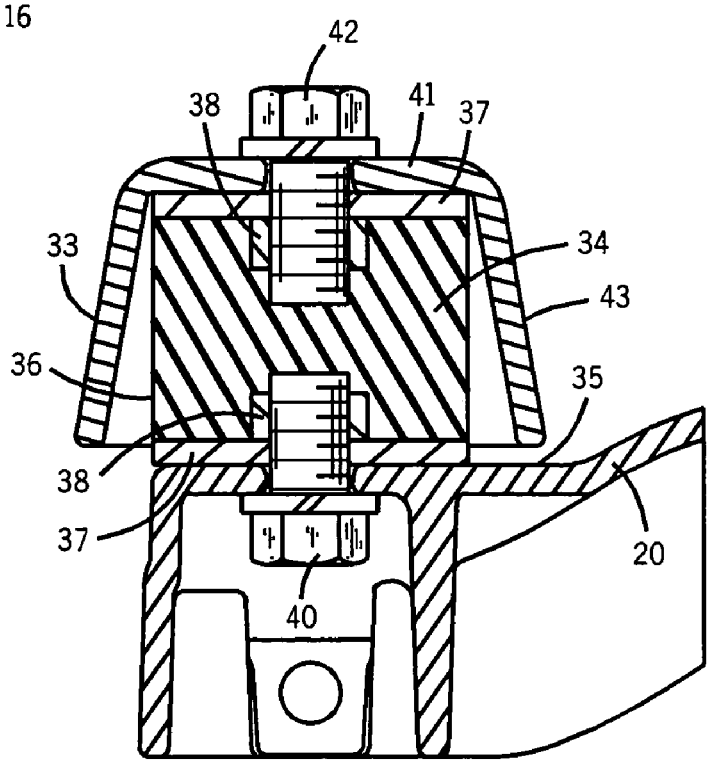
FIG. 4

CONCRETE SCREED WITH VIBRATION ISOLATION

BACKGROUND AND SUMMARY

The present invention pertains to a manually operated, engine driven vibratory concrete screed and, more particularly, to an improved vibration isolation and control system for such a screed.

Vibratory screeds are used to smooth the surface of freshly poured concrete and eliminate air pockets within the concrete mass. One type of manually operated screed is driven by a small gasoline engine (e.g. 1 to 2.5 horsepower) that turns an eccentric exciter mechanism to impart a high speed vibratory force to a screed blade attached to the exciter mechanism. For example, an engine operating in the range of 5,000–7,500 rpm will generate in a centrifugal force in the range of about 245 lbs. to 550 lbs. This type of vibratory screed includes an operating handle connected through a frame piece to the vibratory exciter and engine. The machine is pulled over the surface of the concrete and a small amount of fresh concrete will build-up behind the blade to ensure that the surface is uniform and depressions are not created. The blade may be up to 24 feet in length and, although vibration of the blade helps make the concrete flow, the operator must still pull the machine. When the build-up of concrete behind the blade is uneven, there is a tendency for one end of the blade to lift and create an uneven surface. The operator must tilt the operating handle downwardly on one side to generate a force sufficient to counteract the upward movement of the blade. This requires the operator to exert a large amount of force on the handle. Also, the screed blade may have to be turned horizontally over the surface of the concrete, as when moving around a curve or a corner, requiring the operator to exert a large amount of force on the handle in a generally horizontal plane.

It is also necessary to isolate the transmission of vibration from the exciter and blade to the operator. Specifically, the frame that carries the operator handle is isolated from its connection to the blade or to the exciter mechanism with rubber or other elastomer vibration isolators. It is desirable to use as soft a vibration isolator as possible to provide maximum vibration isolation for the operator. However, because of the high loads that the operator must impose on the blade for the reasons discussed above, harder vibration isolators are required in order to provide an adequately stiff connection between the operator handle and the blade to transmit the required control force. Soft vibration isolators, e.g. those having a durometer of about 30 provide excellent vibration isolation for the operator, but are too soft to permit adequate force to be transmitted from the handle, through the isolators, to the blade. Soft isolators also amplify the distance through which the operator must move the operating handle to adequately control the blade. The operator handle may be as much as 3.5 feet from the vibration isolators such that a very small amount of movement at the isolator connection is magnified into a large amount of movement where the operator grasps the operating handle.

SUMMARY OF THE INVENTION

In accordance with the present invention, a vibration isolation system for a vibratory screed which includes a blade, a vibratory exciter mechanism driven by an engine and attached to the blade, and an operating handle frame connected to the exciter mechanism, comprises a bifurcated frame member having a pair of arms positioned to straddle the exciter mechanism for attachment on laterally opposite sides thereof; an elastomeric vibration isolator captured between each arm and a surface of the exciter mechanism, the isolator being confined to limit vertical compressive movement and to permit substantially greater horizontal shear movement; and a retainer attached to each of the arms or to the exciter, the retainer adapted to engage the isolator to limit the amplitude of horizontal shear movement. Preferably, each arm of the frame member includes an upper attachment surface, and the opposite sides of the exciter mechanism have mounting surfaces that are disposed generally parallel to the upper attachment surfaces, and the isolators are confined between the attachment surfaces and the mounting surfaces.

In a presently preferred construction, the isolators include rigid upper and lower end plates that have threaded connectors attached thereto, and the attachment surfaces and the mounting surfaces are adapted to receive threaded fasteners for attachment to the threaded connectors. Each of the upper attachment surfaces is formed integrally with a retainer. In the preferred embodiment, each of the retainers comprises a downwardly opening cup having an upper base surface that forms the attachment surface and a downwardly divergent side wall that is positioned to engage the isolator to limit the amplitude of horizontal movement. Each of the isolators preferably comprises a cylindrical body, and the retainer cup has a frustoconical shape that is coaxial with the cylindrical axis of the isolator in a no-horizontal-load rest position, the cup wall positioned to engage the isolator under a horizontal shear load to provide the amplitude limit. The elastomeric isolator is preferably made of a natural rubber material having a durometer of about 30.

The apparatus also includes an elastomeric support isolator that is attached at one end to the frame member between the frame arms and at an opposite end to the surface of the exciter mechanism. The exciter mechanism includes an exciter housing that is positioned between the arms of the frame member and has an upwardly extending exciter drive shaft. The engine is positioned directly above the exciter housing and includes a downwardly extending output shaft connected to the exciter drive shaft, and an engine output shaft housing connected to the exciter housing with a flexible connection. The flexible connection includes an elastomer housing and a plurality of elastomer shock absorbers surrounding the elastomer coupling.

BRIEF DESCRIPTION OF THE DRAWINGS

FIG. 3 is a side elevation showing the mounting of the elastomeric vibration isolator of the present invention.

FIG. 4 is a vertical section taken on line 4—4 of FIG. 3.

DETAILED DESCRIPTION OF THE PREFERRED EMBODIMENT

Figure 1:
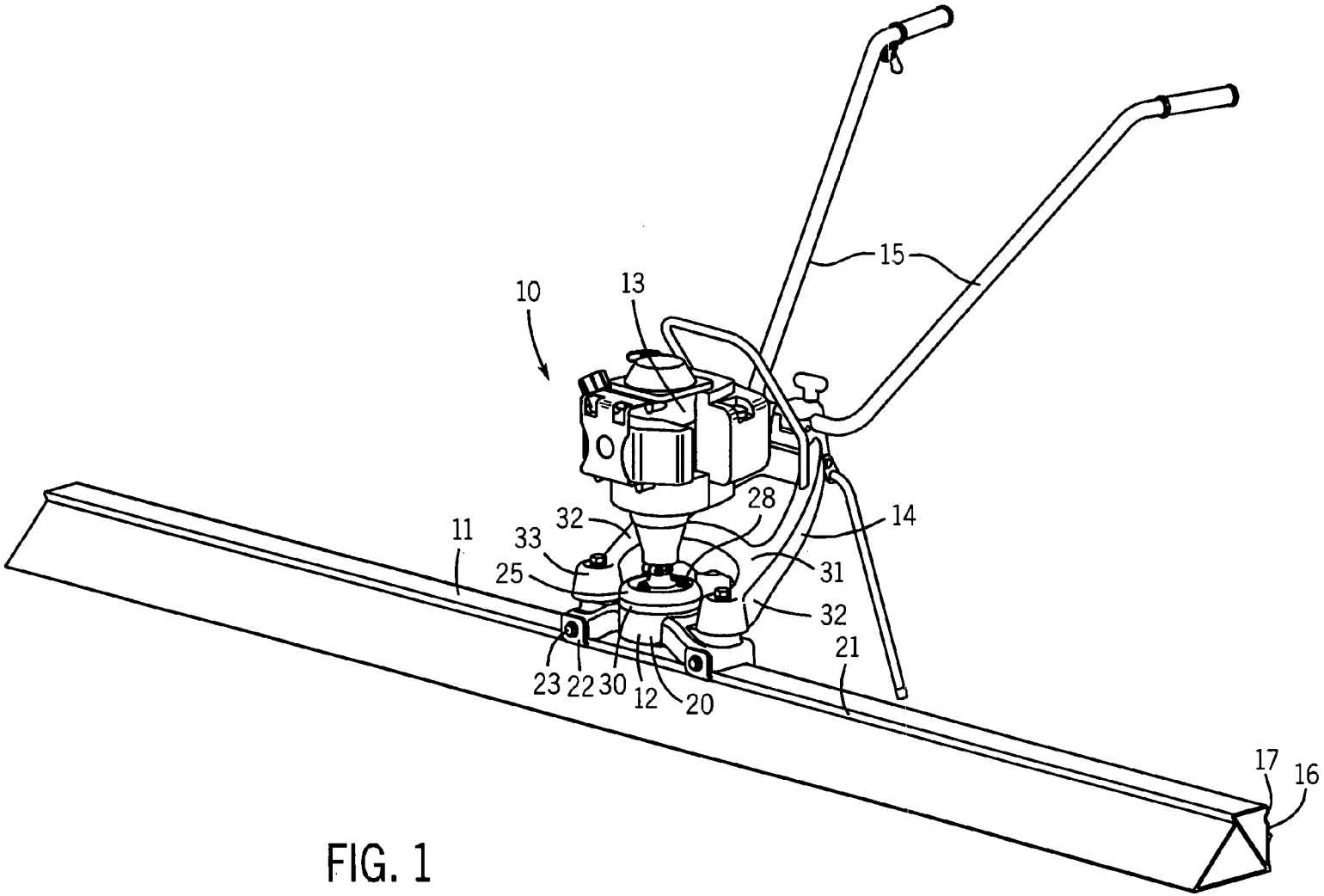
FIG. 1 is a perspective view of a vibratory concrete screed incorporating the subject invention.

A vibratory concrete screed 10 includes a long blade 11 which may be made, for example, from an aluminum or magnesium extrusion. The blade may have a length of up to about 24 feet. The blade 11 is clamped to the underside of an exciter mechanism 12 which includes an eccentric device driven by an engine 13 to impart a horizontal vibratory motion to the blade 11. A supporting frame 14 is attached to the exciter mechanism 12 and includes an operator handle 15. The screed 10 is operated over the surface of freshly poured concrete by the operator pulling the blade from the operator handle 15. The vibration isolation system of the present invention is intended to overcome the problems in prior art devices, discussed briefly above, while providing necessary isolation of vibratory force to the operator. These problems include control of the tendency of the blade to move upwardly when the build-up of concrete behind the blade is uneven, and the need to pull one end of the blade in a circular arc around the opposite end as for movement around a curve. Both of these operations require a large amount of force to be exerted by the operator and, if the vibration isolation device between the operator handle and the exciter is too soft, control becomes difficult. On the other hand, if the vibration isolating device is too hard, then the vibratory forces transmitted to the operator become too great.

The blade 11 is demountably attached to the bottom of the exciter mechanism 12 such that the working face 16 of the blade faces the operator grasping the handles 15, whereby the screed is pulled over the surface of the freshly poured concrete. As best seen in FIGS. 1 and 3, the upper edge of the working face 16 of the blade 11 is provided with a horizontal mounting rib 17 that is received in a groove 18 in a casting that comprises a lower exciter housing 20. The front of the blade 11 also includes an upper horizontal mounting rib 21 over which a pair of mounting clips 22 are attached to the housing 20 with machine screws 23 to clamp the blade 11 to the exciter housing 20.

Figure 2:
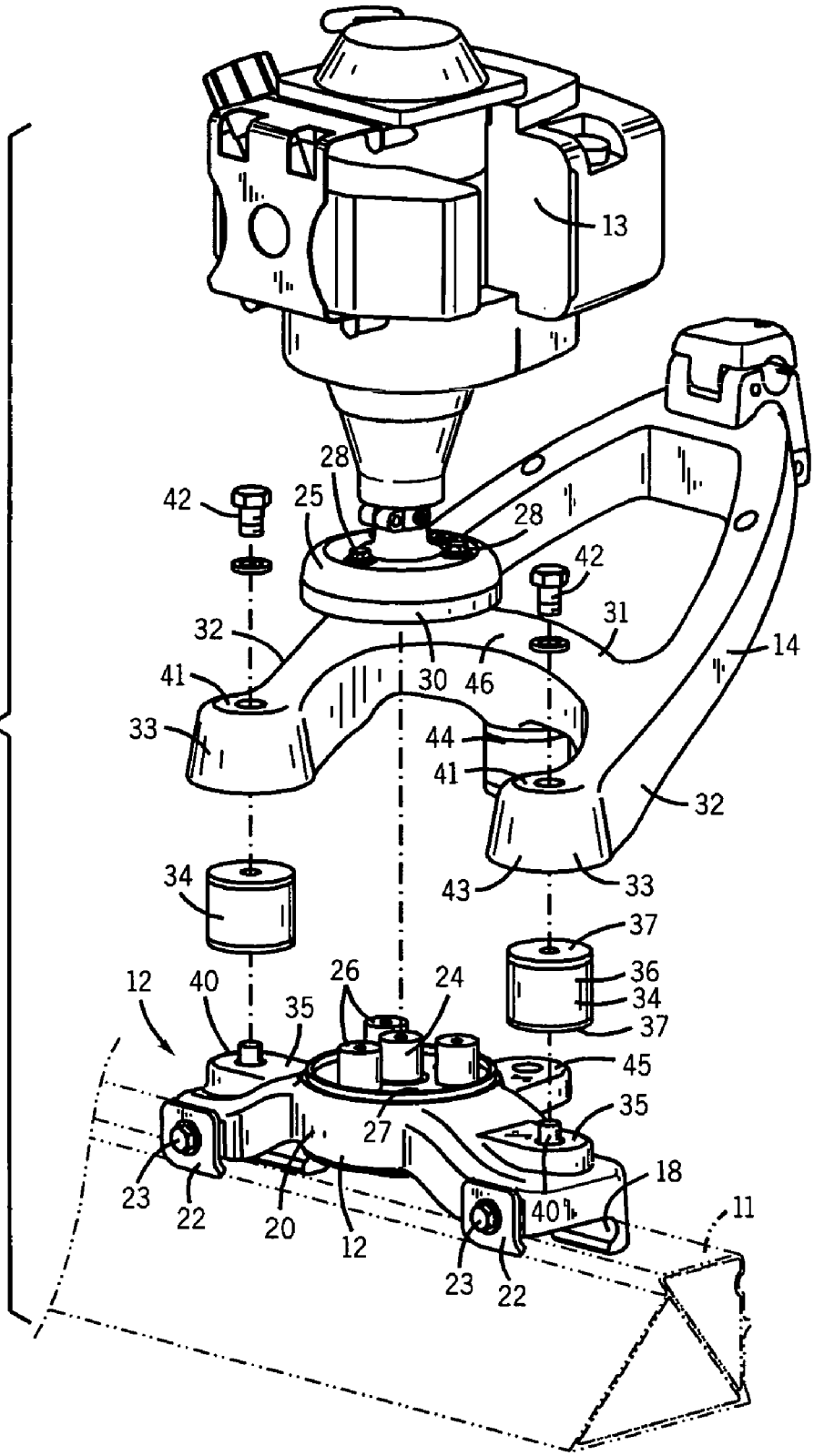
FIG. 2 is an exploded perspective view of a portion of the apparatus shown in FIG. 1.

Referring also to FIG. 2, the engine 13 is mounted vertically above and directly to the exciter housing 20 and includes a direct driving connection between the engine drive shaft (not shown) and an eccentric exciter mechanism mounted within the housing 20 via a flexible elastomer coupling 24. The flexible coupling 24 is enclosed in an engine output shaft housing 25 attached to the engine and overlying the exciter housing, the engine output shaft housing also enclosing three elastomer shock absorbers 26 equally spaced around the flexible coupling 24. The shock absorbers 26 interconnect the engine output shaft housing 25 and the exciter housing 20. Each of the shock absorbers 26 is attached at its lower end to a coupling surface 27 on the exciter housing 20 and at its upper end to the engine output shaft housing 25 with machine screws 28. As shown in FIG. 1, in the assembled position, the interface between the exciter housing 20 and the clutch housing 25 is sealed with an annular seal 30. The direct driving connection between the engine 13 and the exciter mechanism 12 eliminates the need for a gear box or transmission and also helps isolate the transmission of vibrations from the engine to the operator handle.

The main supporting frame 14 includes a bifurcated lower frame member 31 defining a pair of mounting arms 32. Each of the arms 32 terminates in a downwardly opening cup 33 which encloses an elastomeric vibration isolator 34 and provides means for attaching the isolator to the arm 32. The lower ends of the vibration isolators 34 are attached to a mounting surface 35 on the exciter housing 20 on opposite sides of the exciter mechanism. Referring also to FIG. 4, the vibration isolators 34 are of a conventional construction, but are mounted and restrained in a unique manner that isolates the transmission of vibration to the operator yet provides the operator with the ability to control blade movement when the operator is required to exert additional force to the operator handle 15. Each vibration isolator 34 includes a cylindrical body of an elastomer material, preferably natural rubber, with a relatively soft formulation, preferably about 30 durometer. The flat opposite ends of the elastomer body 36 are molded or otherwise attached to rigid metal end plates 37 to which nuts 38 or other suitable internally threaded connectors are welded. Each of the vibration isolators 34 is connected to the mounting surface 35 on the exciter housing 20 with a machine screw 40 extending upwardly through the underside of the mounting surface and into threaded engagement with a nut 38. Each of the cups 33 includes an interior upper attachment surface 41 which engages the upper end plate 37 of the isolator 34 when the latter is inserted into the cup. Connection between the isolator 34 and the frame arm 32 is completed with an upper machine screw 42 extending through the attachment surface 41 and into threaded engagement with the nut 38 at the upper end of the isolator. With this isolator mounting arrangement, the isolators 34 are confined to significantly limit vertical compressive movement, but are capable of undergoing substantially greater horizontal shear movement because of the substantially unconfined elastomer body 36 combined with the low durometer and high flexibility of the elastomer material. The downwardly opening cups 33 within which the isolators 34 are confined, each has a generally frustoconical downwardly divergent wall 43. In the no-load at rest position, there is no contact between the cylindrical elastomer body 36 and the wall 43 of the cup. In this mode, which is the predominant operating position over most conditions of use, the low durometer elastomer bodies 36 are very effective in isolating the transmission of vibration back through the arms 32 and frame member 31 to the operator handle 15. However, when the operator must exert substantial force on the operator handle, as discussed above, movement of the operator handle and frame relative to the exciter housing 20 and blade 11 will result in horizontal deflection of the elastomer bodies 36 until a portion of the inside surface of the frustoconical walls 43 come into contact with the elastomer bodies. This contact provides, temporarily, a more rigid connection between the operator handle 15 and the blade 11, thereby permitting the operator to exercise direct and more positive control. The cups could also be formed integrally with and as a part of the exciter housing 20, such that the cups would be upwardly opening. Furthermore, the cups could have a cylindrical or other shape and the elastomer isolator body have a frustoconical or other shape. The important feature is shear movement of the isolators be permitted, but confined to certain maximum limits.

To provide additional support and a more stable connection between the exciter housing 20 and the supporting frame 14, an elastomeric support isolator 44 is attached between the frame member 31 and a rear support surface 45 on the exciter housing 20. The support isolator 44 may be of a construction identical to the vibration isolators 34. The upper end of the support isolator 44 is attached to an intermediate frame portion 46, between the arms 32, with a threaded stud (not shown) attached to the intermediate frame portion and threaded into the upper end of the support isolator 44. Similarly, the lower end of the support isolator 44 is connected to the rear support surface 45 with a machine screw (not shown) extending upwardly through the surface 45 and into threaded engagement with the isolator 44. However, the support isolator 44 need not be and is preferably not confined in a cup, as are the vibration isolators 34. The support isolator assists in transmitting vertical downward movement imposed by the operator on the operator handle to the blade.

It should be noted that the flexible elastomer coupling 24 and the elastomer shock absorbers 26 that comprise the flexible connection between the exciter housing and the clutch housing 25 may be identical to the vibration isolators 34 and the support isolator 44, except that the flexible coupling 24 and shock absorbers 26 are smaller in size. The durometer of these shock absorbers, however, may be somewhat higher for example, about 50.

The invention claimed is:

1. A vibration isolation system for an engine-driven vibratory screed, including a blade, a vibratory exciter mechanism including the engine attached to the blade, and an operating handle frame connected to the exciter mechanism, the improvement comprising:

a bifurcated frame member having a pair of arms positioned to straddle the exciter mechanism for attachment on laterally opposite sides thereof;

an elastomeric vibration isolator captured between each arm and a surface of the exciter mechanism, said isolator confined to limit vertical compressive movement and to permit substantially greater horizontal shear movement; and a retainer attached to one of the arms and the exciter, said retainer adapted to be spaced from the vibration isolator in normal operation and to engage the isolator in response to movement of the operating handle relative to the exciter mechanism and the blade to limit the amplitude of horizontal shear movement.

2. The apparatus as set forth in claim 1 wherein each arm includes an upper attachment surface;

the opposite sides of the exciter mechanism are provided with mounting surfaces disposed generally parallel to the upper attachment surfaces of said arms; and, said isolators are confined between said attachment surfaces and said mounting surfaces.

3. The apparatus as set forth in claim 1 wherein said isolators include rigid upper and lower end plates having threaded connectors attached thereto; and, said attachment surfaces and said mounting surfaces are adapted to receive threaded fasteners for attachment to said threaded connectors.

4. The apparatus as set forth in claim 3 wherein each of said attachment surfaces is formed integrally with said retainer.

5. The apparatus as set forth in claim 4 wherein each of said retainers comprises a downwardly opening cup having an upper base surface forming said attachment surface and a downwardly divergent side wall positioned to engage the isolator to provide said amplitude limit.

6. The apparatus as set forth in claim 1 wherein said retainer includes a downwardly opening cup having a downwardly divergent side wall positioned to engage the isolator to provide said amplitude limit.

7. The apparatus as set forth in claim 6 wherein each of said isolators comprises a cylindrical body with flat axially opposite ends, said flat ends providing surfaces for capture of the isolator; and, said cup wall having a frustoconical shape that is coaxial with the cylindrical axis of the isolator in a non-horizontal-load rest position, said cup wall positioned to engage the isolator under a horizontal shear load to provide said amplitude limit.

8. The apparatus as set forth in claim 7 wherein said retainer cup includes an upper attachment surface for one of the isolator ends, and wherein the laterally opposite sides of said exciter include mounting surfaces for the other of the isolator ends.

9. The apparatus as set forth in claim 1 wherein said elastomeric isolator comprises a natural rubber material.

10. The apparatus as set forth in claim 9 wherein said rubber material has a durometer of about 30.

11. The apparatus as set forth in claim 1 including an elastomeric support isolator attached at one end to the frame member between said arms and at an opposite end to the surface of the exciter mechanism.

12. The apparatus as set forth in claim 11 wherein the exciter mechanism includes an exciter housing positioned between the arms of the frame member and having an upwardly extending exciter drive shaft;

the engine is positioned directly above the exciter housing and includes a downwardly extending output shaft connected to the exciter drive shaft; and, an engine output shaft housing connected to the exciter housing with a flexible connection.

13. The apparatus as set forth in claim 12 wherein the flexible connection comprises an elastomer coupling.

14. The apparatus as set forth in claim 13 wherein said flexible connection further comprises a plurality of elastomer shock absorbers surrounding said elastomer coupling.

15. A vibration isolation system for an engine-driven vibratory screed, including a blade, a vibratory exciter mechanism attached to the blade, and an operating handle frame connected to the exciter mechanism, the improvement comprising:

a frame member having end portions adapted for operative attachment to laterally opposite sides of the exciter mechanism;

an elastomeric vibration isolator captured between each end portion and a surface of the exciter mechanism, said isolator mounted to permit a given amount of horizontal shear movement;

a retainer attached to one of the end portions and the exciter mechanism, said retainer adapted to be spaced from the vibration isolator in normal operation and to engage the isolator in response to movement of the operating handle relative to the exciter mechanism and the blade to limit the amplitude of horizontal shear movement; and, an engine operatively connected to and supported on the exciter mechanism.

16. The apparatus as set froth in claim 15 including an elastomeric support isolator attached at one end to the frame member between the end portions and at an opposite end to the surface of the exciter mechanism.

17. The apparatus as set forth in claim 16 wherein the exciter mechanism includes an exciter housing positioned between the end portions of the frame member and having an upwardly extending exciter drive shaft;

the engine is positioned directly above the exciter housing and includes a downwardly extending output shaft connected to the exciter drive shaft; and, an engine output shaft housing connected to the exciter housing with a flexible connection.

18. The apparatus as set forth in claim 17 wherein the flexible connection comprises an elastomer coupling.

19. The apparatus as set forth in claim 18 wherein said flexible connection further comprises a plurality of elastomer shock absorbers surrounding said elastomer coupling.

20. The apparatus as set forth in claim 15 wherein said isolators are confined to limit vertical compressive movement and to permit substantially greater horizontal shear movement.

* * * * *